United States Patent [19]

Starr et al.

[11] Patent Number: 4,953,637

[45] Date of Patent: Sep. 4, 1990

[54] APPARATUS FOR RECOVERING GROUND SOIL SAMPLES

[75] Inventors: Robert C. Starr, Cambridge; Robert A. Ingleton, Waterloo, both of Canada

[73] Assignee: University of Waterloo, Waterloo, Canada

[21] Appl. No.: 347,716

[22] Filed: May 5, 1989

[30] Foreign Application Priority Data

May 9, 1988 [GB] United Kingdom ..... 8810942

[51] Int. Cl.[5] ..... E21B 25/10

[52] U.S. Cl. ..... 175/20; 175/249

[58] Field of Search ..... 73/864.45; 175/244, 175/249, 20

[56] References Cited

U.S. PATENT DOCUMENTS

| | | | |
|---|---|---|---|
| 4,161,988 | 7/1979 | Hart | 173/32 |
| 4,284,150 | 8/1981 | Davis | 175/84 |
| 4,332,541 | 6/1982 | Doty | 175/162 |
| 4,400,970 | 8/1983 | Ali | 73/84 X |
| 4,685,339 | 8/1987 | Philipenko | 73/864.45 |

*Primary Examiner*—Tom Noland

*Attorney, Agent, or Firm*—Anthony Asquith & Co.

[57] ABSTRACT

The apparatus includes a sample-holder comprising a tube (16) of thin aluminum, and a piston (12) slidable in the tube. The piston is mounted on a solid, robust piston rod (14). To drive the apparatus down to the depth at which the sample is to be taken, the piston and tube are locked together, and travel down in unison, most of the force of the hammer blows being taken by the robust piston rod. When sampling depth is reached, the piston rod (14) is uncoupled, and the piston (12) is restrained by means of a cable (36) to the surface; further hammering now drives only the tube (16) downwards, not the piston. The tube being thin, the drive force is must less, whereby the tube does not collapse, as the sample enters the tube.

6 Claims, 2 Drawing Sheets

APPARATUS FOR RECOVERING GROUND SOIL SAMPLES

This invention relates to the taking of samples of ground soil from holes in the ground. The samples may be used for the purpose of testing groundwater for contamination, or for other purposes.

BACKGROUND TO THE INVENTION

It is the usual practice to collect the sample in a long tubular container. The container is open at its bottom end and, when the container is driven into the ground soil, the sample enters the container. After withdrawal from the hole, the container may be cut or slit along its length in order to remove the sample. The tubular container is normally destroyed in the process of removing the sample.

The invention is concerned with a need to provide a sampler for use in extracting samples in reasonably soft ground, from depths below the surface, without the need for a drill, and in remote locations. Such a sampler should be light to carry, and should need minimum ancillary equipment. The sampler should have these facilities without compromising the quality of the samples.

These factors will now be considered in more detail:

1. Regarding the accessibility of the site from which the sample is to be taken, the invention is for use in those cases where it is not economical to carry and install heavy equipment, power supplies, drill rigs, etc.
2. Regarding the depth from which the sample is to be taken, the invention is for use in those cases where it will be possible to reach the required depth using a few sections, and where it will be possible to drive the sampler to the required depth by the use of a hammer. There is a limit to the depth to which it is economical to drive a sampler by hammering from the surface, so that for deeper samples, it would be necessary to use a drill. The invention has no particular benefits in the case where the sample is being taken right at the surface, ie where the sampler does not have to travel down through a layer of overburden to reach the sampling interval: there are many inexpensive ways of taking samples from the surface.
3. Regarding the type of groundsoil likely to be encountered, both in the sample, and in the ground above the sample, through which the container will have to pass, the invention is for use in those cases where the cohesiveness, abrasiveness, penetration-resistance, and water-content of the soil are such that the container can be simply driven into the ground, without drilling. Even when the groundsoil is soft, the invention would not be used if the groundsoil were to contain large cobbles.
4. Regarding the pattern of sampling required, the invention is for use in those cases where ease of movement of the sampling apparatus to a different site is required, such as when taking samples at regular points on an area grid, for example.
5. Regarding the depth accuracy required for the sample, the invention is for use in those cases where an accurate knowledge is required of the depth from which the sample came. The invention is also for use in those cases where it is required to take samples from different depths, using the same hole.

In some techniques for recovering samples, the procedure includes flushing water down the hole. This may spoil the sample, especially if it is the groundwater characteristics of the sample that are being studied. The invention is for use in cases when it is desired to avoid adding water to the hole.

One of the problems encountered when recovering samples of very soft, almost-cohesionless, groundsoil is that the sample tends to fall out of the containing tube as the tube is being withdrawn out of the hole. The invention provides a good resistance to the sample falling out of the container.

A particular advantage of the invention is that all the equipment needed to recover samples can be carried on a light truck of the rough-terrain type. A two man crew is normally all that is needed for operating the equipment used in the invention.

The invention is particularly addressed to the taking of samples in soft ground at reasonably shallow depths in remote areas. The invention is particularly concerned with how such samples may be recovered in an economical manner, without compromising the integrity and reliability of the sample.

In the type of sample-taking operation with which the invention is concerned, the operation is carried out in two distinct stages. First, the sampler is driven down through the ground to the level at which sampling is to start, and nothing enters the container during this stage. Then in the second stage, the sampler is driven further into the ground, and now the sample does enter the container.

The main problem faced by the designer of equipment for taking samples from soft ground is that the force required to drive the container down into the ground, even through soft soil, is enough to collapse the sample containing tube. The problem can of course be solved by using a more robust container, but then the container would be expensive. Also, if the container were more robust, it would be hard to cut open the container, for removing the sample. From the standpoint of economy, and of ease of exposing the sample, the container tube should be thin: but from the standpoint of drivability, the container should be robust.

GENERAL DESCRIPTION OF THE INVENTION

It is recognized in the invention that the force required to drive the sampler down into the ground is a function of the axially-projected cross-sectional area of the sampler. If the sampler has an area of, say, 20 or 30 sq cm, the force required to drive that sampler through even the softest soil is large enough that, if the container has to suffer the full driving force, the container must be thicker and more robust than is economically practical in a container that is going to be destroyed after just one use. On the other hand, even the thinnest of containers likely to be considered for the containment of samples of ground soil could support the driving forces if the forces were of the magnitude associated with an area of, say, 1 sq cm.

It is recognized, in the invention, that during the first stage of operation, which is when the the sampler is being driven down through the overburden to the sampling level, the force required to drive the sampler is that associated with the full area of the sampler. On the other hand, in the second stage of operation, when the sampler is being driven down and the sample is entering the container, the force required to drive the sampler down is determined by the axially-projected annular area, not of the sampler as a whole, but only of the container tube itself. Since the container tube is thin, the (annular) cross-sectional area of the container may be in the 1 sq cm range. Consequently, the force required to drive the container tube on its own is quite small, and can be small enough in magnitude to be supported by the container itself.

It is recognised, in the invention, that during the first stage of the driving operation, the driving force are too heavy for the container to support on its own, but it is also recognised, in the invention, that during the second stage of the driving operation, the forces are light enough that the container now can support them on its own.

In the invention, the sampler includes a container in the form of a thin tube. Inside the tube is a piston. Attached to the piston is a piston drive rod, which is dimensioned to be solid and rigid, and which is well able to transmit to the piston the forces associated with the first stage of the driving operation. A means is included for maintaining the piston at the foot of the container tube during the first stage. In the invention, a hammer block means is included for receiving hammer blows applied from above: to enable the sampler to be operated in the first driving stage, the hammer block means is arranged to transmit the force of the blows directly to the rigid piston rod, and thence to the piston. The arrangement is such that, during the first stage, the container is carried down in unison with the piston.

When the sampler reaches the level at which the sample is to be taken, the second driving stage commences. The hammer block means is transferred from acting on the top of the piston rod so as to act on the top of the container. A means is included for allowing the piston to rise up inside the container tube, and to travel along the length of the container tube. Thus, as the container is driven downwards, during stage two, the piston may remain anchored at the same level.

Preferably, this facility for relative movement between the container and the piston during stage two is realized by adding a length of sleeve as an extension to the container, but by not adding an extension to the piston rod. The hammer block may then be positioned on top of the sleeve, and also the piston rod may be provided with a restraining means, such as a cable, which is secured above ground. The arrangement may be such that as the container is driven down into the ground during stage two, the piston remains stationary. The soil beneath the piston, into which the container is being driven, is therefore not pushed aside, but enters the container.

Once the sample has been collected in the container, the sampler may be lifted out of the ground.

It is essential, in the invention, that the piston is connected to a solid, rigid, rod for transmitting the hammer blows directly to the piston during the first stage of the driving operation, ie while driving the sampler down to the depth at which sampling will start. During this first stage the groundsoil of the overburden is being pushed aside by the advancing sampler, and a substantial driving force is required to do this. During the first stage, the container and the piston are driven down into the groundsoil in unison.

During the second stage, the piston is allowed to become free to move within the container. In stage two the hammer blows are transmitted to the container, and are not transmitted to the piston rod. Thus, during stage two, only the container moves down into the soil, and the groundsoil is not pushed aside by the advancing container, but enters into the container. The force required to drive the container down during stage two is much less than the force required during stage one.

It is one of the aims of the invention to provide a sampler which is strong enough and rigid enough to be driven by hammering, so that a substantial superstructure is not required.

BRIEF DESCRIPTION OF THE DRAWING FIGURES

By way of further explanation of the invention, an exemplary embodiment of the invention will now be described with reference to the accompanying drawings, in which.

Figure 2:
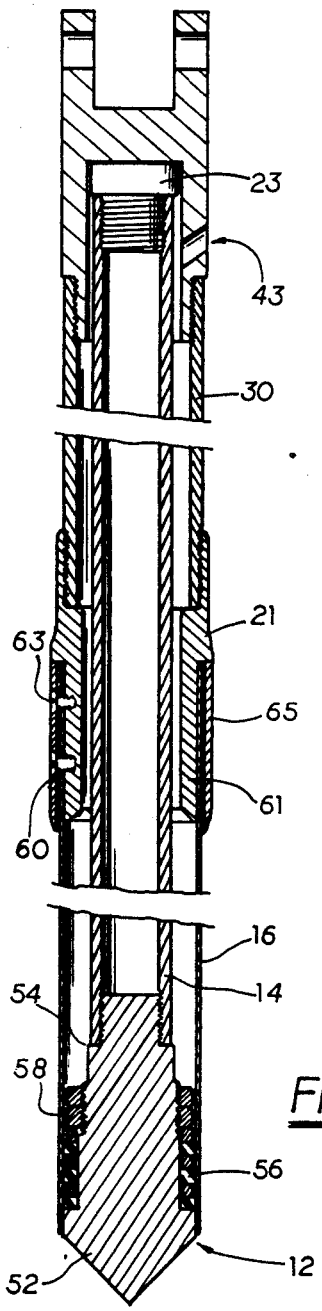
FIG. 2 is a detailed cross-sectional elevation of the apparatus of FIG. 1 during a first operational stage.
Figure 3:
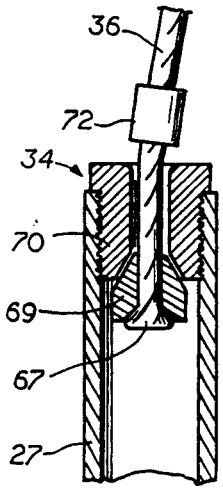

FIG. 3 corresponds to FIG. 2, but shows the apparatus in a second operational stage.

DETAILED DESCRIPTION OF PREFERRED EMBODIMENT

The sampler shown in the accompanying drawings and described below is an example of a sampler which embodies the invention. It should be noted that the scope of the invention is defined by the accompanying claims, and not necessarily by features of specific embodiments.

The sampler 10 comprises, at the start of the sampling operation (FIG. 1A), a piston 12, a thick, rigid, piston rod 14, a thin-walled sample-container 16, and a drive head 18. The piston 12 is screwed to the piston rod 14.

The container 16 is shown 1.5 meters long, and about 5 cm in diameter.

The drive head 18 includes a hammer block 20, and an adapter 21. The upper end of the piston rod 14 is provided with a protective cap 23, which engages directly against the undersurface of the hammer block 20.

Prior to setting up the sampler, a suitable scaffolding is erected at the sampling site. The scaffolding provides an overhead support 25 and provides platforms (not shown) at various convenient heights, to allow the required access to the sampler, so that the engineer may carry out the various steps as will now be described.

In FIG. 1A, the sampler has just started being driven into the ground. The engineer has positioned himself on a suitable one of the platforms, and is driving the assembly downwards by means of a jack hammer.

Figure 1:
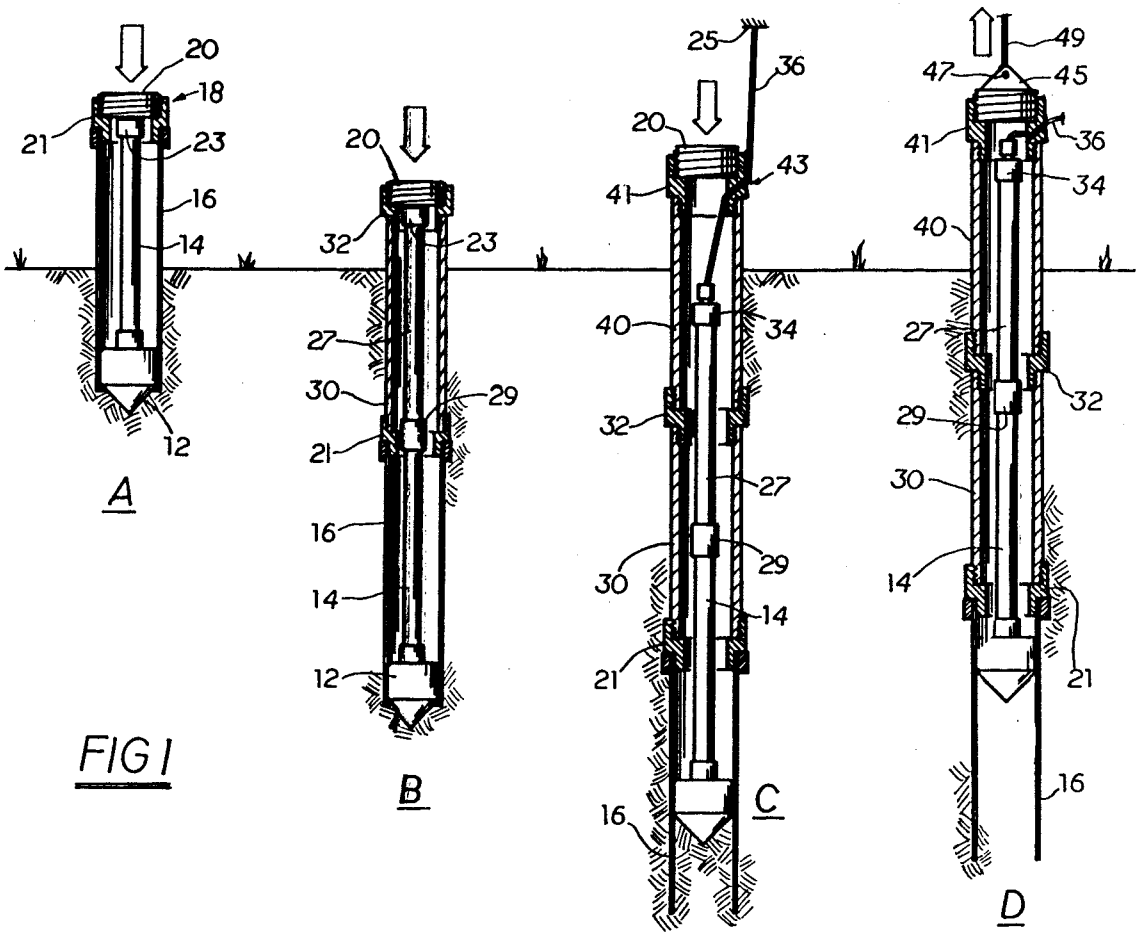
FIG. 1 is a diagrammatic representation of a sampling apparatus, shown in various stages of operation.

The engineer continues to drive the assembly as shown in FIG. 1 down until just the drive head 18 is left protruding above ground level. Now, the engineer must fit a new section to the sampler. He unscrews the hammer block 20 from the adapter 21, and lays the hammer block aside. Next, he unscrews the cap 23 from the top of the piston rod 14. He screws another length 27 of piston rod to the original piston rod 14, using an adapter 29, and he fits the cap 23 to the top of the new length 27 of piston rod.

The engineer then screws a sleeve 30 into the adapter 21. He fits a fresh adapter 32 (which is identical to the adapter 21) to the top of the sleeve, and he screws the hammer block 20 into the adapter 22.

The engineer then proceeds to drive the second section of the sampler into the ground, to the required depth, as shown in FIG. 1B. (It can be arranged that further sections may be added to the sampler, and driven into the ground, if required.)

It will be noted that throughout the FIGS. 1A and 1B stages, the main force of the blows from the jack hammer will be taken by the solid, rigid, piston rod 14,27, and transmitted to the piston 12. A proportion of the force of the blows, however, is transmitted through the thin, and relatively flimsy, sampler container 16. The proportion of the blow taken by the piston 12 relative to th container 16 is determined by the sizes of the cross-sectional areas of each relative to the other, and since the annular area of the container 16 is very much smaller than the area of the piston 12, the main brunt of the hammer blows will be taken by the piston rod and piston, not by the container 16.

The add-on sleeve 30 is of much more robust dimensions than the sample container 16. The container 16 will contain the sample of groundsoil, and it is intended that the container will be slit lengthwise in order to reveal the sample. As a general rule, the container 16 will be discarded after one use. So, the container must be thin, and of relatively soft material, otherwise the job of slitting the container would be too difficult. Also, since the container will be thrown away, it should preferably be cheap to produce, and of cheap material. Although the container 16 should therefore be thin and flimsy, the add-on sleeve 30, however, is not restricted in that way.

After the second section of the sampler has been driven into the ground (FIG. 1B) the engineer now prepares the sampler for stage two of the driving operation, in which the sample container 16 is driven down further into the ground, while at the same time the piston 12 is constrained against any further movement downwards.

To do this, the engineer once again removes the hammer block 20. He removes the cap 23 from the top of the rod length 27. He screws onto the top of the rod 27 a cable connector 34, to which is attached a cable 36. The arrangement of the connector 34 is such that the cable 36 may swivel, or rotate, with respect to the rod 27.

Next, the engineer screws a further sleeve 40, which is identical to the sleeve 30, to the adapter 32. He screws yet another adapter 41, which is like the adapters 21,32, into the top of the further sleeve 40. Now, the engineer feeds the cable 36, which at this point lies inside the sleeve 40, out through a hole 43, which has been provided for that purpose in the side of the adapter 41.

The cable 36 is secured to the overhead support 25, and is drawn tautly enough to ensure that the piston 12 is held firmly thereby against any further downward movement.

Finally, the engineer screws the hammer block 20 into the adapter 41, and proceeds once again to drive the sampler into the ground, as shown in FIG. 1C.

During the FIG. 1C stage, the force required to drive the sampler down is much reduced. Only the small annular area of the thin material of the container 16 is, at this point, being driven into the ground. The piston 12 remains at the level at which it is tethered by the cable 36. The ground soil directly beneath the piston 12 also remains stationary, so that when the sampler has been driven fully into the ground, the container 16 surrounds a body or core of groundsoil, and the piston 12 lies at the top end of the sampler container 16.

The next step of the procedure is to withdraw the sampler, together with the sample of groundsoil just collected, out of the hole. To do this, the engineer removes the hammer block 20, and screws in its place in the adapter 41 a trunnion 45. He secures a shackle 47 and cable 49 in turn to the trunnion 45. The cable 49 is connected to a winch 50 provided in the overhead support 25, and the sampler is winched out of the hole.

The cable 36 may, as a usual rule, be left slack as the sampler is winched up. However, there is a danger, if the cable 36 is left slack, that the piston 12 might slip inside the sampler, and might not rise exactly in unison with the sampler. If it is feared that the piston might slip during winching of the sampler, the cable 36 may be clamped to the adapter 41, or the cable may be otherwise secured to a suitable point on the sampler.

As the sampler emerges, it must be dismantled in sections. The trunnion 45 is transferred from the adapter 41 to the adapter 32, and then to the adapter 21, as the sampler is finally pulled clear.

Once the sampler is out of the ground, the adapter 21 is removed from the container 16, and the piston 12 is pulled out of the top end of the container. Since the piston is a tight fit in the container, it may be preferred to cut off the end of the container tube, below the piston. It is preferred to disturb the sample as little as possible, and cutting off the container may be less disruptive than pulling out the tight piston.

The sample container 16, with the sample inside it, is capped, and transported to the laboratory for evaluation. Alternatively, the sample may be analysed on the spot.

The scaffolding may be easily moved to another site, if required, and the sampler made ready for the next sample to be taken.

Further details of the construction of the sampler will now be described.

In FIG. 2, the piston 12 includes a piston body 52. The upper end of the body is suitably threaded for receiving the (hollow) piston rod 14. The piston rod 14 is tightened down onto a shoulder 54 on the body 52, and the design of the joint should be such that the hammer blows are transmitted through the shoulder, not through the thread.

The piston is also provided with seals 56, made of rubber. Several seals 56 are provided, which are held apart by washers, as shown. The seals may be compressed in the axial direction by tightening an adjusting nut 58. Compressing the seals in this manner allows the tightness of the seals within the container 16 to be adjusted; the seals should be set tightly enough that the piston will not slip in the container when the sampler, and sample, are winched out of the ground. On the other hand, when the sampler is being hammered into the gound during the FIG. 1C phase, the piston is required to slide inside the container 16, and the seals should not be so tight that this action would be impeded.

The piston rod 14 should be of suitable robustness for transmitting the hammer blows to the piston 12 without damage. The container 16, on the other hand is thin, and is made of, for example, aluminum, or even plastic, and is capable of taking only very light hammer blows.

The container 16 is simply a length of plain tubing, which is cut off to the appropriate length. Since the container is to be thrown away after one use, it is preferred that the container should be as simple to make as possible, and in the case of the container 16 as illustrated, for example, the only type of machining operation required, apart from cutting the tubing into lengths, is to drill six holes 60 through the material of the tubing.

A template may be provided for use in drilling the holes 60, to ensure that the holes are aligned correctly.

The adapter 21 is provided with a nose 61 for receiving the top end of the container 16. Threaded holes are provided in the nose, and so placed as to line up with the holes 60 in the container.

The screws 63 that are used to secure the container 16 to the adapter 21 are necessarily short, and it should be noted that short screws, even when fully tightened, are notoriously liable to shake loose. The shorter the screw, the more possible it is that tension in the screw can be lost momentarily during heavy vibration, allowing the screw to loosen. In the case of the screws 63, particularly, the screws are liable to shake loose, since the sampler is being subjected to repeated blows from a jack hammer. It is therefore preferred to provide some means for preventing the screws 63 from shaking loose. The manner in which this is done, however, should take into account the fact that the screws need to be assembled and disassembled every time the sampler is used.

As shown in FIG. 2, a clamp 65 is fitted around the top of the container 16, and the screws pass through the clamp. The clamp 65 is actually in three sections, so that the clamp may be assembled over the container in a radial direction. Bonded to the inside of each sector is a pad 67 of rubber. Now, when the screws 63 are tightened, the rubber is compressed. Thus, even when the sampler is being vigorously hammered, the screws never lose tension, and therefore remain tight.

As shown in FIG. 3, the cable connector 34 includes a swivel joint. The cable 36 is provided with a bulbous end 67, formed by spreading the strands and applying silver solder. A cone 69 is fitted over the bulbous end 67. A cable plug 70 is provided, which is arranged to be screwed into the top end of the piston rod extension 27. The top of the cone 69 is arranged to bear against the bottom of the plug 70. The hole down the centre of the plug 70 is large enough that the cable 36 may rotate freely within the plug 70. A boss 72 is clamped to the cable 36, in order to ensure that the plug 70 and cone 69 stay together even when the plug is not screwed into the piston rod 27.

The cable may therefore rotate relative to the rod 27 and relative to the sleeve 40. This is important because it allows the various screw threaded connections to be assembled and disassembled without causing the cable 36 to coil up.

It has been stated that the force required to drive the container 16 into the ground, on its own, during stage two of the driving operation, is very small, and this is true. However, this does not necessarily mean that the hammer blows need only be very light during stage two. The hammer blows may need to be quite heavy, because of the presence of the clamp 65.

Since the clamp 65 presents a larger axially-projected area than the container, the hole must consequently be widened slightly as the clamp passes down the hole, and the force required to enlarge the hole must come from the hammer. The extra axially-projected area caused by the clamp 65 might typically be around 5 sq cm. Therefore, since the area of the container itself is 1 sq cm, or even less, clearly far more effort is required to drive the clamp 65 down than is required to drive the container 16 down.

The force felt by the container is determined by the axially-projected area of the container, and is therefore very small, even though the force from the hammer, during stage two, is much heavier. On the other hand, the force transmitted through the sleeve 30 is the higher force, as determined by the force needed to drive the clamp 65 and to enlarge the hole, and therefore the sleeve 30 needs to be much more robust than the container 16.

In the apparatus described, it was required to start admitting the sample into the container at a depth of twice the length of the container tube, ie at a depth of about 3 meters. This start-depth can be extended by adding more of the extension sleeves 30, and more of the piston rod extensions 27.

The sampling apparatus of the invention permits the taking of below-ground samples very economically, especially on a reconnaissance basis, in remote locations. No expensive heavy equipment, such as drills, casings, pumps, is required. The hammer may be a hand-held gasoline powered jack-hammer. The quality of the samples recovered is high, the depth from which the sample was taken is accurately known, and the disturbance to the ground is a minimum.

We claim:

1. Apparatus for recovering ground soil samples, wherein:

the apparatus includes a piston assembly, comprising a piston and a piston rod;

the piston rod is of solid robust construction, whereby the piston rod is able to transmit downwardly directed drive forces rigidly to the piston;

the apparatus includes a tubular container, in which the piston is sealingly slidable;

the ground soil sample is collected in the tubular container from a ground soil source as a core sample;

the apparatus includes a two-condition drive-transmitting means;

in the first condition, the drive-transmitting means is effective to transmit the drive force acting downwards on the apparatus to the piston assembly;

in the second condition, the drive-transmitting means is effective to transmit said drive force to the container.

2. Apparatus of claim 1, wherein:

the drive-transmitting means includes a hammer block;

in the first condition the hammer block is in solid drive-transmitting engagement with both the piston assembly and the container whereby the piston assembly and the container travel downwards in unison;

in the second condition, the hammer block is in drive-transmitting engagement with the container, and is not in drive-transmitting engagement with the piston assembly.

3. Apparatus of claim 1, wherein:

the apparatus includes activatable tether means which, when activated, is effective to prevent downward motion of the piston assembly.

4. Apparatus of claim 3, wherein:

the tether means comprises a cable which is securable above ground.

5. Apparatus of claim 1, wherein:

the tubular container is of thin, relatively flimsy, construction, whereby the container is too weak to support, by itself, the downwardly directed drive forces of the magnitude required to drive the piston assembly into the ground;

the container is robust enough to support the downwardly directed drive forces of the magnitude required to drive itself in to the ground.

6. Apparatus of claim 1, wherein:

the apparatus includes an extendable outer sleeve, which is in drive-transmitting engagement with the container;

the outer sleeve is of more robust construction than the container.

* * * * *